US008429889B2

(12) United States Patent
Lee

(10) Patent No.: US 8,429,889 B2
(45) Date of Patent: Apr. 30, 2013

(54) APPARATUS AND METHOD FOR PRODUCING A YARN

(76) Inventor: David Arthur Lee, Christchurch (NZ)

( * ) Notice: Subject to any disclaimer, the term of this patent is extended or adjusted under 35 U.S.C. 154(b) by 556 days.

(21) Appl. No.: 12/516,982

(22) PCT Filed: Dec. 20, 2007

(86) PCT No.: PCT/NZ2007/000377

§ 371 (c)(1),
(2), (4) Date: Feb. 26, 2010

(87) PCT Pub. No.: WO2008/079025

PCT Pub. Date: Jul. 3, 2008

(65) Prior Publication Data

US 2010/0175360 A1 Jul. 15, 2010

(30) Foreign Application Priority Data

Dec. 22, 2006 (NZ) ..... 552416

(51) Int. Cl.
*D02G 3/22* (2006.01)

(52) U.S. Cl.
USPC ..... 57/293; 57/204; 57/264

(58) Field of Classification Search ..... 57/204, 57/264, 293, 294
See application file for complete search history.

(56) References Cited

U.S. PATENT DOCUMENTS

| | | | | |
|---|---|---|---|---|
| 3,443,370 | A * | 5/1969 | Walls | 57/293 |
| 4,186,549 | A | 2/1980 | Chambley et al. | |
| 5,094,068 | A * | 3/1992 | Hirao | 57/334 |
| 5,243,812 | A | 9/1993 | Strobel et al. | |
| 5,660,035 | A * | 8/1997 | Musha et al. | 57/264 |
| 5,706,642 | A * | 1/1998 | Haselwander | 57/264 |
| 6,311,920 | B1 * | 11/2001 | Jennings et al. | 242/477.6 |
| 6,443,379 | B2 * | 9/2002 | Lassmann | 242/178 |
| 6,484,962 | B2 * | 11/2002 | Lassmann | 242/478.1 |
| 7,752,832 | B2 * | 7/2010 | Lee | 57/293 |
| 2005/0279075 | A1 | 12/2005 | Kersey | |
| 2006/0144033 | A1 * | 7/2006 | Lee | 57/1 R |

FOREIGN PATENT DOCUMENTS

| | | |
|---|---|---|
| DE | 202004002638 U1 | 6/2005 |
| NZ | 336048 | 1/2001 |
| WO | WO-2004-044290 | 5/2004 |

OTHER PUBLICATIONS

International Search Report (PCT/ISA/210) issued in PCT/NZ2007/000377, May 29, 2008, Summit Wool Spinners Limited.

(Continued)

*Primary Examiner* — Shaun R Hurley
(74) *Attorney, Agent, or Firm* — Edwards Wildman Palmer LLP; Brian R. Landry

(57) ABSTRACT

Apparatus and a method for producing a yarn, the apparatus and method comprising a reciprocating twisting stage, the reciprocating twisting stage comprising one or more twist rollers that rotate along an axis of rotation and that are arranged to move reciprocally along the axis of rotation to impart twist to one or more slivers to form twisted strands; and a drive system for one or more take up holders, the drive system arranged to have wound onto the one or more take up holders the yarn after two or more strands are twisted together to form the yarn. The drive system is arranged to drive the one or more take up holders such that the linear speed at which the yarn is wound onto the one or more take up holders can be controlled relative to the linear speed at which the strands exit the one or more twist rollers.

20 Claims, 4 Drawing Sheets

OTHER PUBLICATIONS

International Preliminary Report on Patentability (PCT/IB/373) issued in PCT/NZ2007/000377, Jul. 2, 2009, Summit Wool Spinners Limited.

Supplementary European Search Report for EP Application No. EP 07 86 6884 dated Nov. 29, 2011.

Canadian Office Action issued in Canadian Application No. 2,671,143 on Jun. 18, 2012.

* cited by examiner

APPARATUS AND METHOD FOR PRODUCING A YARN

This application is the U.S. national phase, pursuant to 35 U.S.C. §371, of PCT international application Ser. No. PCT/NZ2007/000377, filed Dec. 20, 2007, designating the United States and published in English on Jul. 3, 2008 as publication WO 2008/079025 A1, which claims priority to New Zealand application Ser. No. 552416, filed Dec. 22, 2006. The entire contents of the aforementioned patent applications are incorporated herein by this reference.

FIELD OF INVENTION

The invention relates to apparatus and a method for producing a self-twisting yarn. In particular, the invention relates to apparatus and a method that are each directed toward controlling and varying the different twist profiles of yarns that can be produced.

BACKGROUND

Self-twisted yarns are yarns that comprise two or more strands that have areas of twist in what is known as the z-direction and areas of twist in what is known as the s-direction (that is, the strands have alternating areas of twist in opposing directions). The twisted areas in the strands are each separated by non-twisted areas. Torque is trapped in the twisted strands and is otherwise known as residual twist. When two or more twisted strands are brought together, the torque, or residual twist, causes the strands to twist around each other naturally, without interference, to form a self-twisted yarn.

The different fabrics and purposes for which self-twisted yarns are used may require different yarns having a specific yarn structure suitable for that purpose. For example, next-to-skin fabrics used in vests generally require lightweight and soft yarns, fabrics to be used in socks require yarns that are capable of wicking away moisture, and fabrics that are used in outer layers of clothing, such as trousers, require yarns of sufficient strength that the fabric is long-wearing.

Further information regarding self-twisted yarns is found in the book "Structural Mechanics of Fires, Yarns and Fabrics", by J. W. S. Hearle, P. Grosberg, and S. Backer, John Wiley and Sons Inc, USA, 1969, page 139; and also in the book "The Mechanics of Wool Structures", by R. Postle, G. A. Carnaby, and S. de Jong, Ellis Horwood Ltd, England, 1988, page 131.

In producing a yarn formed of staple fibres or predominantly of staple fibres, such as wool, cotton, synthetic staple fibres, or a mixture of such fibres, a number of slivers may, typically after drafting, be passed through a twisting stage, which comprises reciprocating rotating rollers (twist rollers), which move from side to side as the slivers pass between the rollers, thereby imparting a twist to the strands. After exiting the twist rollers, the strands are brought together to twist naturally with each other to form a multi-ply yarn. Apparatus or machines for so producing a yarn are disclosed in Australian patent specifications 51009/64, 9432/66, 26099/67, and 25258/71.

New Zealand patent 336048 discloses a method for producing a yarn comprising three or more slivers, or ends, in which the three slivers are passed between reciprocating twist rollers and then one or more of the slivers is passed over a path of a different length before the slivers are brought together. Rather than all of the slivers or ends passing through the twisting stage together and then being twisted naturally together, the twist in one or more of the slivers or ends is staggered or out of phase relative to the twist in the other slivers.

PCT Patent Application No. PCT/NZ2003/000253 (published as WO 2004/044290) discloses an apparatus for producing a yarn comprising a plurality of twisted strands, which enables aspects of the twist profile imparted to the yarn to be controllably varied by using a control system to control the rotational speed of the twist rollers and/or the extent of transverse movement of the twist rollers, and thus influences the properties of the yarn or fabric or knitted or woven products formed from the yarn.

These prior art apparatus and methods allow for some forms of yarns having different yarn structures to be produced. However, one major problem with the yarn produced by these prior art apparatus and methods is that the yarn structure is inconsistent both along the length of a yarn produced and between different runs of yarn produced. Inconsistent yarn structures are undesirable and result in lower grade and inconsistent quality fabrics being produced when using such yarns. The inventors of this invention have found that this inconsistent yarn structure can be due to fluctuations in tension imparted on the strands of the yarn during self-twisting of the yarn. The prior art apparatus and methods have the disadvantage that they are unable to control the tension imparted on the twisted strands of yarn after the strands exit the twisting stage.

The inventors have identified a way of alleviating the inconsistencies in yarn structure by controlling the tension imparted on twisted strands as the strands self-twist together to form a yarn. By controlling the tension imparted on the twisted strands, it is not only possible to create yarns having a substantially consistent yarn structure, but is also possible to produce a greater variety of yarns having certain yarn structures/twist profiles according to the use for which the yarns will be employed. Therefore, it is an object of the invention to provide apparatus and a method for improved control of the yarn structures of yarns produced, so that purpose specific yarns having a consistent yarn structure can be manufactured, or to at least provide a useful choice.

SUMMARY OF INVENTION

The invention provides an improved or at least alternative apparatus and method for producing a yarn comprising a plurality of twisted strands.

In one aspect, the invention broadly comprises an apparatus for producing a yarn, the apparatus comprising:

a reciprocating twisting stage adapted to simultaneously twist one or more slivers to produce one or more twisted strands, the reciprocating twist stage comprising one or more twist rollers that rotate along an axis of rotation and that are arranged to move reciprocally along the axis of rotation of the one or more twist rollers to impart twist to the one or more slivers, and a drive system for one or more take up holders, the drive system arranged to have wound onto the one or more take up holders the yarn after twisting together of strands to form the yarn, the drive system for the one or more take up holders being arranged to drive the one or more take up holders such that the linear speed at which the yarn is wound onto the one or more take up holders is either lower or higher than the linear speed at which the strands exit the one or more twist rollers.

Preferably, the apparatus further comprises one or more take up holders onto which the yarn can be wound.

In a further aspect, the invention broadly comprises an apparatus for producing a yarn, the apparatus comprising:

a reciprocating twisting stage adapted to simultaneously twist one or more slivers to produce one or more twisted strands, the reciprocating twisting stage comprising one or more twist rollers that rotate along an axis of rotation and that are arranged to move reciprocally along the axis of rotation of the one or more rollers to impart twist to the one or more slivers, and a drive system for one or more take up holders, the drive system arranged to have wound onto the one or more take up holders the yarn after twisting together of strands to form the yarn, the drive system for the one or more take up holders being arranged to drive the one or more take up holders such that the linear speed at which the yarn is wound onto the one or more take up holders is lower than the linear speed at which the strands exit the one or more twist rollers.

Preferably, the apparatus further comprises one or more take up holders onto which the yarn can be wound.

Preferably, the drive system is arranged to drive the one or more take up holders such that the linear speed of take up of the yarn onto the one or more take up holders is between about 0.1 and 5%, more preferably between about 0.25 and 3%, and most preferably between about 0.5 and 2%, lower than the linear speed at which the strands exit the one or more twist rollers.

In the apparatus of the invention, the yarn may be wound onto the one or more take up holders at a slightly lower linear speed than the speed at which the strands exit the one or more twist rollers. This may beneficially cause areas of twist in the slivers to enlarge or increase in length, into what would otherwise be adjacent areas of non-twist in the slivers. Where the yarn has some elasticity, for example only a few percent elasticity, the strands emerge from the one or more twist rollers extended and it has been discovered that a lack of tension between the reciprocating one or more twist rollers and the final one or more take up holders beneficially results in the strands contracting to a non-extended state.

Preferably, the apparatus comprises a control system arranged to control the rotational speeds of the one or more take up holders and one or more twist rollers relative to one another. The control system may also enable controlled variation of the rotational speed of the one or more take up holders and the one or more twist rollers relative to one another during operation of the apparatus.

Preferably, the control system also facilitates control and variation of one or more of the transverse speed, the extent of the transverse reciprocal movement, and the rotational speed of the one or more twist rollers, to enable wide variation of the twist profile imparted to the one or more slivers and to, in turn, enable the production of yarns having a wide range of different twist profiles.

In broad terms, the invention, in another aspect, comprises a method for producing a yarn, the method comprising: passing two or more slivers through a reciprocating twisting stage to produce two or more twisted strands, each strand comprising areas of twist separated by areas of non-twist, bringing the strands together to form the yarn by self-twisting with each other, and taking up the yarn onto a take up holder at a linear take up speed which is lower than the linear speed at which the strands exit the twisting stage.

Preferably, the two or more slivers of staple fibres, or predominantly of staple fibres, are passed through the reciprocating twisting stage together with two or more core filaments, the slivers and core filaments together being of about or less than about 30 TEX, to produce two or more twisted strands, each strand comprising areas of twist separated by areas of non-twist and a core filament. The strands are subsequently brought together to form the yarn and are taken up onto a take up holder at the lower linear speed than the linear speed at which the strands exit the twisting stage. Preferably, the yarn is of between about 10 and 30 TEX. Most preferably, the yarn is of between about 15 and 30 TEX, and further the yarn may be of between about 10 or 15 and about 20 or 25 TEX. TEX has its conventional meaning referring to the number of grams weight per 1000 meters of the yarn.

Preferably, the slivers or strands are twisted with a twist of less than 600 or about 500 turns per meter and most preferably, a twist of between about 250-300 and 400-500 turns per meter.

In a further aspect, the invention broadly comprises apparatus for producing a yarn, the apparatus comprising:

a reciprocating twisting stage adapted to simultaneously twist one or more slivers to produce one or more twisted strands, the reciprocating twisting stage comprising one or more twist rollers that rotate along an axis of rotation and that are arranged to move reciprocally along the axis of rotation of the one or more twist rollers to impart twist to the one or more slivers, and a drive system for one or more take up holders arranged to have wound onto the one or more take up holders the yarn after twisting together of strands to form the yarn, the drive system for the one or more take up holders being arranged to drive the one or more take up holders such that the linear speed at which the yarn is wound onto the one or more take up holders is higher than the linear speed at which the strands exit the one or more twist rollers.

Preferably, the apparatus further comprises one or more take up holders.

Preferably, the drive system is arranged to drive the one or more take up holders such that the linear speed of take up of the yarn onto the one or more take up holders is between about 0.1 and 5%, more preferably, between about 0.25 and 3%, and most preferably, between about 0.5 and 2%, higher than the linear speed at which the strands exit the one or more twist rollers.

It has been found though experimentation that by varying the ratio of take up between the twist rollers or delivery rollers and final take up holders, whereby the take up holders operate at higher or lower speeds than the delivery rollers, it is possible to modify the resulting twist profiles of both of the component strands of the yarn together with that of the combined twist of said component strands as they twist together from the torque within the twisted strands.

For example, by operating the take up holders at a lower speed than the delivery rollers, the twisted sector of the strands migrates partially into the non-twisted sector. This, in turn, reduces the torque of the strands and, consequently, the residual twist in the individual strands.

Many variations of this are possible and necessary in order to engineer purpose specific fibre structures which can be designed to create fabrics with specific performance requirements, for example: enhanced wind resistance; improved abrasion resistance; enhanced bulk; etc.

By varying the speed ratio between the twist rollers and the take up holders, the amount of spinning tension imparted on the yarn is affected. Until now, the effect of the spinning tension on the distribution of the twist within the twisted strands, and on the extent to which the twisted strands self-twist together with each other (the amount of residual twist), has not been known.

The apparatus and method of the invention are based on the unexpected discovery that, in the case of self-twisting yarns, the spinning tension affects the twist profile, which ultimately becomes trapped in the two or more twisted strands that are being twisted together to form the yarn. The spinning tension also affects the extent to which a twisted strand self-twists with another twisted strand to form a yarn.

Whilst it is not intended to be limited by theory, it is believed that the tension level in the yarn influences the extent to which the two strands can slip along the line of contact with each other. If the strands do not slip at all, or do not slip significantly, more self-twist or torque is trapped in the strands so that the extent to which the strands self-twist with each other is greater.

It has been found that low spinning tension levels result in more self-twist being trapped in the strands (that is, a greater residual twist is found in the strands) and, therefore, the strands do not slip significantly along the line of contact with each other when the finished yarn is pulled taut. Instead, the strands wrap more tightly around each other, and thus form a yarn with greater twist, than strands that are subject to higher tension after leaving the twist rollers. As such, strands that are subject to high tension after leaving the twist rollers have a different twist profile than those strands that are not subject to such tension.

If the two strands slip past each other by predominantly twisting separately when pulled taut, rather than predominantly wrapping around each other, less self-twist is trapped in the finished yarn. It has been found that high spinning tension levels result in an increase in the extent of twist migration into the areas of non-twist in the strand, resulting in less self-twist being trapped in the strands and, therefore, the strands are less likely to twist or wrap around each other and are more likely to slip along the line of contact when the finished yarn is pulled taut. The same phenomenon does not occur with a normal twisted yarn. This phenomenon is only possible with self-twist yarns and has not previously been identified.

Because the torque in each strand builds up rapidly from the non-twist areas, and because it is strongly affected by the threadline tension, it is possible to predict whether more or less localised slippage of the strands will occur at the contact line, depending on the amount of tension between the twist rollers and the take up holders.

BRIEF DESCRIPTION OF THE DRAWINGS

The apparatus and method of the invention are further described with reference to the accompanying drawings by way of example and without intending to be limiting, wherein.

DETAILED DESCRIPTION

Definitions

The terms "self twist yarn" and "self twisting yarn" as used in this specification and claims means a yarn that comprises two or more strands that have areas of twist in the z-direction alternating between areas of twist in the s-direction, and having areas of non-twist between each area of twist, and where at least one twisted strand is brought into contact with at least one other twisted strand, whereupon the twisted strands self-twist together (wrap around each other) to form a yarn.

The term "strand" as used in this specification and claims is used in its generic sense to include, inter alia, singles strands, plied yarns, spun yarns, and cabled yarns. The strand may be a continuous bundle of filaments, a continuous form of discontinuous filament, a drafted carded sliver, which is untreated or pre-treated to increase its tensile strength, continuous filaments produced by a tow treatment process or a combination of staple fibres, such as spun yarn for example, and one or more continuous filaments.

The term 'comprising' as used in this specification and claims means 'consisting at least in part of', that is to say when interrupting independent claims including that term, the features prefaced by that term in each claim will need to be present but other features can also be present.

PREFERRED EMBODIMENTS OF THE INVENTION

Figure 2:
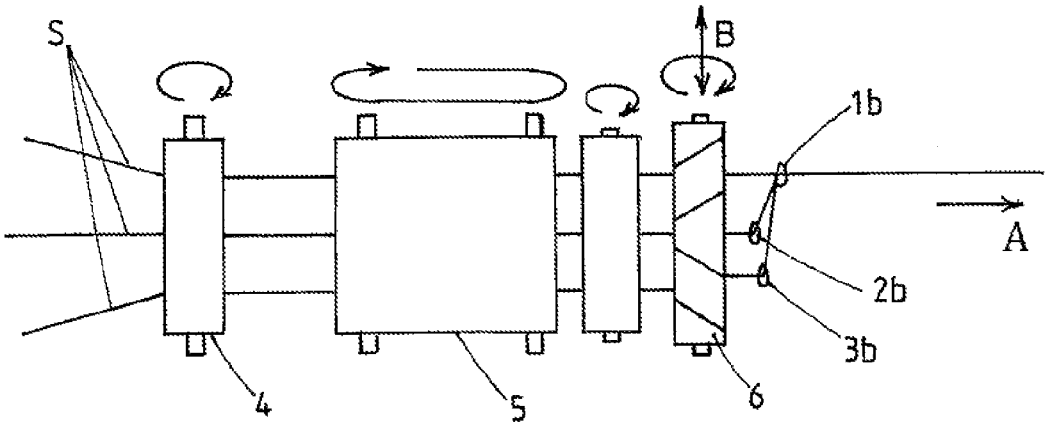
FIG. 2 schematically shows one form of apparatus of the invention from above.

Referring to FIG. 2, a first preferred form of apparatus comprises a drafting unit 5 comprising opposed moving, preferably rubber coated, rollers or belts, between which the fibres pass (as slivers). In the example shown, three slivers S (unspun) of, for example, wool drawn from drums or other bulk supply (not shown), are fed between rollers 4 and through the drafting unit 5 and are drawn out.

Typically, the thickness of a wool fibre assembly is reduced to between one half to one twenty-fifth of the initial thickness after passing through the drafting unit 5. The amount of thickness reduction may be adjusted by altering the rotational speed of the drafting unit. The direction of travel of the slivers (along the threadline) through the apparatus is indicated by arrow A in FIG. 2.

Figure 3:
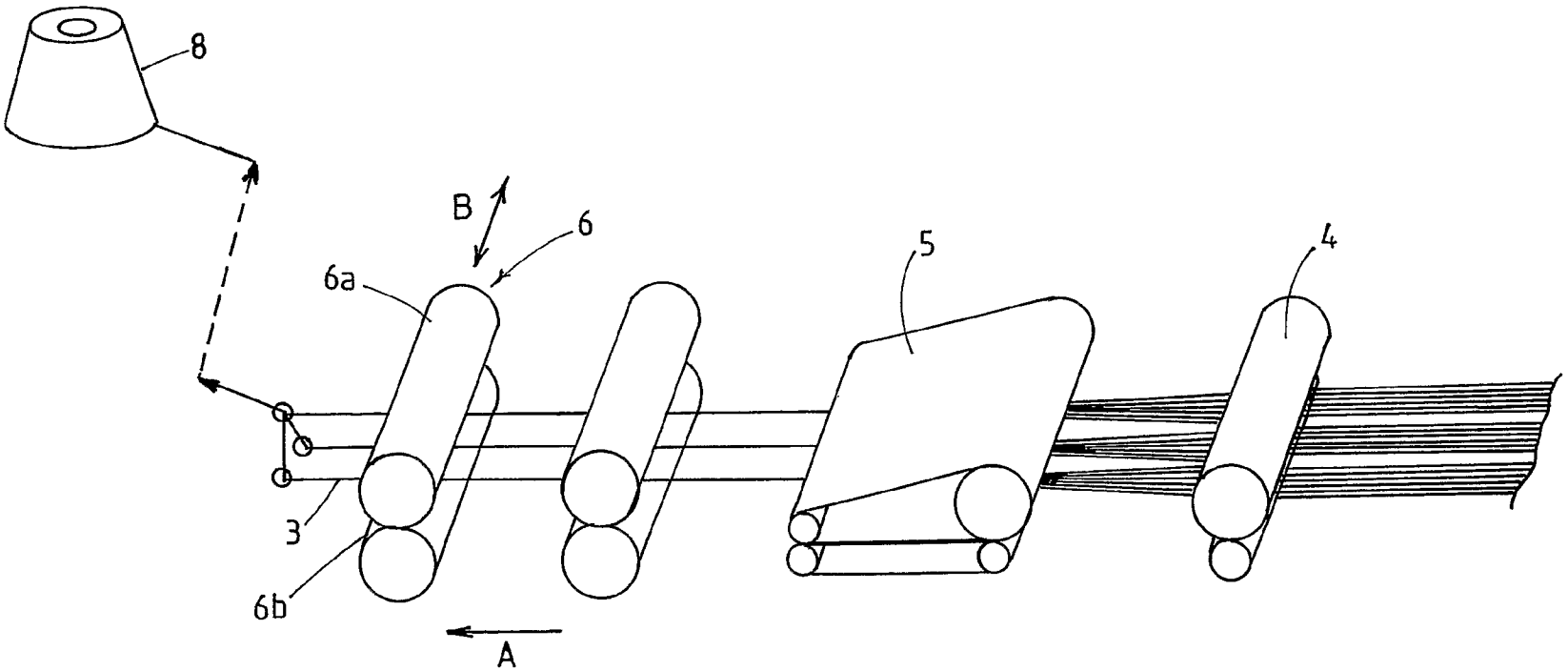
FIG. 3 shows major parts of the apparatus from one side, showing the drafting unit and twist rollers thereof.
Figure 4:
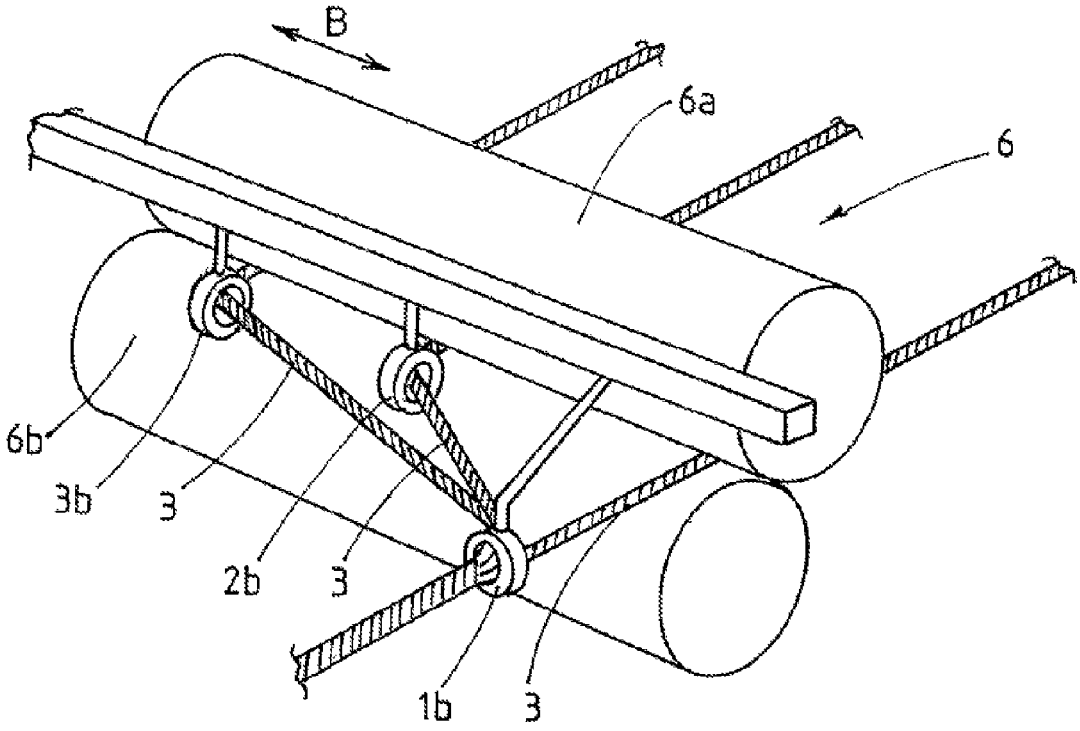
FIG. 4 shows the strands exiting the twist rollers being brought together by guides.

A reciprocating twisting stage 6 comprises a pair of rotating rollers 6*a* and 6*b* (see FIGS. 3 and 4), one or both of which also reciprocate back and forth, as indicated by arrow B in FIGS. 3 and 4, transversely to the direction of movement of the slivers as the machine operates. These rotating and reciprocating rollers 6*a* and 6*b* are referred to herein as twist rollers.

The twist rollers 6 impart twist on the slivers passing between the rollers in one direction as the twist roller(s) move(s) one way, followed by twist in the opposite direction as the twist roller(s) move(s) the other way in operation. The twisted slivers are generally referred to herein as strands. Areas of non-twist are formed in the strands at the point at which the roller(s) change(s) direction.

In an alternative form of the invention, a single reciprocating roller may move relative to a flat surface over which the slivers pass, to twist the slivers between the roller and surface.

Referring to FIG. 4, following the reciprocating twisting stage, to produce one form of yarn, one or more of the twisted strands is led directly through primary guide or eyelet 1*b*, while the other strands are led through secondary guides or eyelets before also passing through primary guide 1*b*, so that some strands have a different path length before entering primary guide 1*b*. In the embodiment of the invention shown in FIG. 4, a strand passes through guide 2*b* whilst another strand passes through guide 3*b* before both strands pass through primary guide 1*b*.

As the strands 3 exit the eyelet 1*b* they tend to self-twist together to form a yarn. Alternatively, a further twisting mechanism may optionally be provided to assist in twisting the strands together to form the finished yarn.

Each of the strands may pass over a path of different length relative to the other strands, so that the areas of twist in each of the strands are staggered, or out of phase, relative to one another. In this form of yarn, the different path lengths are such that areas of non-twist in each strand are overlaid with areas of twist in other strands in the finished yarn.

Areas of non-twist in the strands are weaker than areas of twist. Therefore, it is often important to reduce the areas of non-twist in yarns. By staggering the strands, weak points in the yarn may be avoided and the strength of the yarn along its length is more consistent.

Figure 5:
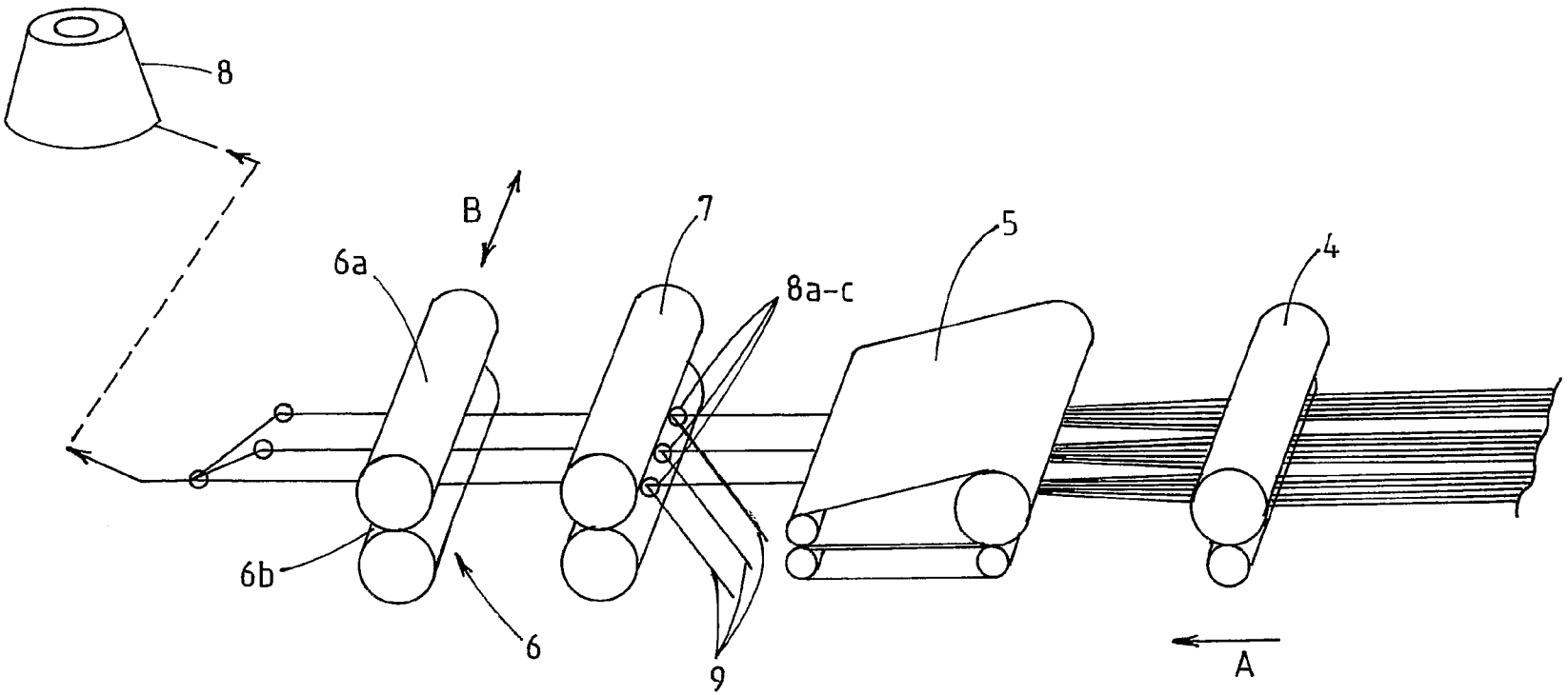
FIG. 5 is a view of major parts of another apparatus of the invention from one side.

The yarn then passes to a take up holder 8, such as a spool, onto which the yarn is wound, as schematically indicated in FIGS. 3 and 5. An electro-mechanical drive system for the take up holder 8 is controlled by a control system such that the linear speed at which the yarn is wound onto the take up holder 8 is slightly lower than the linear speed at which the strands exit the twist rollers 6. A common control system controls the rotational speed of the twist rollers 6*a* and 6*b* and of the take up holder 8.

The circumference of the take up holder and spooled yarn gradually increases as more yarn is wound onto the take up holder 8. Thus, if the rotational speed of the take up holder is kept constant, the twisted strands exiting the twist rollers or delivery rollers would be under increasing tension as more yarn is wound onto the take up holder. It has been found that the gradually increasing tension on the strands, as a length of yarn is produced, results in a change in the twist profile along the length of the yarn.

It has also been found that environmental factors, such as humidity, can affect the machinery components of prior art spinning machines that are used to impart tension on self-twisting yarns, so that the positive tension imparted on yarns by those machines is inconsistently applied when environmental factors change.

Therefore, the apparatus of the invention provides a control system that ensures that as the yarn is wound onto the take up holder 8, the speed at which the take up holder is driven reduces, so that the linear speed at which the yarn is wound onto the take up holder is kept constant at a slightly lower speed than the linear speed at which the strands exit the twist rollers.

It has been discovered that changing the tension imparted on self-twisting yarns after the twisted strands exit the twist roller(s) changes the twist profile, yarn structure, and properties of the yarn. In particular, it has been found that yarns that are subject to low tension (low tension yarns), after exiting the twisting stage and before spooling onto the take up holder, will have a different yarn structure to yarns that experience positive tension after exiting the twisting stage (high tension yarns). The same phenomenon does not occur with a normal twisted yarn and is only possible with self-twisting yarns. This phenomenon has not previously been identified.

By providing the ability to create a range of different yarns having different profiles, structures, and properties, it is possible to produce specific yarns to satisfy a specific purpose. For example, low TEX, high strength yarns can be produced for use in lightweight, hardwearing fabrics.

Whilst it is not intended to be limited by theory, it is believed that as the strands of the yarn are twisted in the twisting stage, the twist is temporarily trapped in the strands in the form of torque acting on the strands. The tension imparted on the strands influences the extent to which the two strands can slip along the line of contact with each other as a result of the torque trapped in the strands. The more self-twist or torque is trapped in the strands, then the more the strands will wrap around each other in a self-twisting motion, and the less the strands will slip against each other along the line of contact.

Where less self-twist is trapped in the strands, the strands will slip past each other along the line of contact by predominantly untwisting separately, rather than wrapping around each other. It has been found that high tension yarns have less self-twist trapped in the strands (i.e. less residual twist in the strands) and the strands do not twist around each other to the extent of low tension yarns. Furthermore, high tension yarns are more likely to slip along the line of contact when the finished yarn is pulled taut.

Figure 1A:
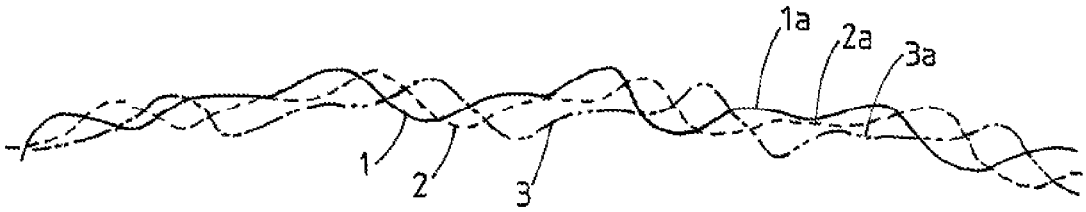
FIG. 1A is a view of a length of one example of yarn which may produced by the apparatus of the invention, and FIG. 1B schematically shows relative positions of the twisted areas in each strand making up the yarn.
Figure 1B:
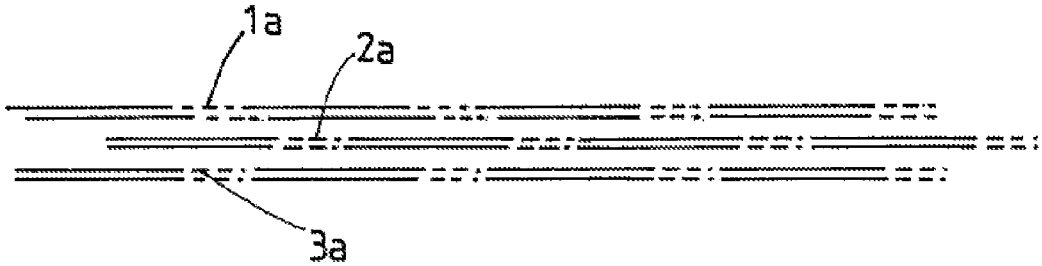

An example of a resulting yarn is schematically shown in FIGS. 1A and B. Referring to FIGS. 1A and 1B, the yarn example illustrated comprises three twisted strands, which are loosely twisted together to form the finished yarn. Each of the strands 1, 2, and 3 are "staggered", or out of phase, relative to each other, so that areas of non-twist 1*a*, 2*a*, and 3*a* in each of the strands of the yarn are overlaid by areas of twist in the other strands, as shown. FIG. 1A exaggerates this for clarity. In the finished yarn, the areas of non-twist in one strand are overlaid by areas of twist in the other strands. FIG. 1B seeks to schematically illustrate this—in FIG. 1B the three strands are shown parallel (before any twisting together) and in each strand the areas of twist (in alternate directions) formed by the twist roller(s) 6 are indicated in hard outline while the areas of non-twist between the areas of twist are indicated in broken outline, as indicated at 1*a*, 2*a*, and 3*a*, for example. Any area of non-twist in any strand, such as non-twist area 1*a*, is overlaid for at least part of its length by areas of twist in the other strands, as shown. In addition, as the yarn is wound onto the take up holder 8, areas of twist in each strand tend to enlarge to reduce the length of the areas of non-twist 1*a*, 2*a*, and 3*a* in each of the strands. A yarn having a profile with large areas of twist will be stronger than a yarn with small areas of twist. Furthermore, a yarn having a profile with large areas of twist and only small areas of non-twist will be of a more even form along its length.

Referring to FIG. 5, a further preferred form of apparatus again comprises an initial optional roller pair 4 and a drafting unit 5 comprising opposed rollers or belts, between which the fibres pass (as slivers). A reciprocating twisting stage 6 comprises a pair of rollers 6*a* and 6*b*, one or both of which rotate as well as reciprocate back and forth across the direction of movement of the slivers as the apparatus operates.

Prior to the reciprocating twist rollers 6*a* and 6*b*, non-twist rollers 7 are provided, with associated ring guides 8*a-c*. Each strand or sliver passes through one of the guides and between rollers 7.

Continuous filaments 9 are introduced at and pass through the guides with the slivers also, and between the rollers 7. Preferably, the continuous filaments are a synthetic monofilament such as a nylon monofilament, but each might alternatively be a synthetic multifilament or a non-synthetic spun filament, for example.

As each sliver of wool, for example, and filament pass through a guide 8*a-c* and between rollers 7, the continuous filament is pressed into the strand or sliver between the rollers 7, before the strand and filament pass through and are twisted by the reciprocating twist roller 6. As an alternative to providing two rollers 7 for this purpose, the strands and filaments may pass between a single roller acting against a flat surface over which the strands pass, to press the filaments into the strands between the roller and surface. The filaments are pressed into the middle of the fibres composed at least predominantly of staple fibres, so that the synthetic filament becomes surrounded by the fibres of the strand. The continuous synthetic filament adds strength to the strand, which, as a result, can be twisted less to achieve higher bulk, thus providing a yarn with greater bulk for a given weight of wool, without loss of tensile strength.

Preferably, the slivers or strands are twisted with a twist of less than 600 or about 500 turns per meter and most preferably, a twist of between about 250-300 and 400-500 turns per meter.

The core filaments have a small percentage of elasticity and emerge from the twist rollers extended. The twisted strands comprising the core filaments are brought together and naturally self-twist together to form a finished yarn. The yarn is then passed to a take up holder around which the yarn is wound.

The central control system controls the rotational speed of the one or more twist rollers and also controls the rotational speed of the one or more take up holders. By controlling the rotational speed of the take up holder(s) with the rotational speed of the twist roller(s), the tension imparted on the yarn exiting the twisting stage can be controlled and varied. The control system may, additionally, control the speed of transverse movement of the reciprocating twist roller(s).

The tension of the yarn between the twist roller(s) and the take up holder(s) affects the amount of torque trapped in the yarn, which, in turn, affects the twist profile of the yarn and particularly affects the extent to which the twisted strands within the yarn self-twist with each other. Therefore, an advantage of the invention is that by varying and controlling the tension of the yarn, different yarns having different twist profiles and, therefore, different yarn structures, can be created such that purpose specific yarns can be manufactured. For example, self-twisting yarns that were subject to low tension between the one or more twist rollers and the one or more take up holders will exhibit a different twist profile than yarns that were subject to high tension between the one or more twist rollers and the one or more take up holders.

Because the amount of tension imparted on the yarn affects the twist profile and strength and softness properties of the yarn, a user can program the control system to set and vary the rotational speed of the take up holder(s) relative to the rotational speed of the twist roller(s) (thus altering the tension imparted on the yarn) so that specific yarns can be produced for a specific purpose.

Another advantage of the invention is that by varying and controlling the tension of the yarn, the tension imparted on the strands can be kept constant so that the yarn structure can be keep consistent.

The lack of tension between the reciprocating twist roller(s) and the final take up holder(s) has the following effects:

the stretched core filaments and the fibres around them contract to a non-extended state;

the twist tends to migrate from the highly twisted area into the non-twisted sector;

this results in the interfibre friction increasing, thereby resulting in greater strength; and the yarn appears more even.

The yarns may be knitted or woven into lightweight fabrics. For example, low TEX yarns may be produced for producing garments for use in next-to-skin applications where the fabric will be in contact with the skin of the wearer, for example. The lightweight fabric may be used for forming a garment, such as a vest, which is the lower-most garment worn by the wearer. Alternatively, the garment may be a second layer garment, or a lightweight garment intended to be the only garment worn rather than being under other garments. For example, the garment may be of wool, such as a Merino wool vest.

Such garments, when woven from wool yarn, are generally woven from a wool yarn having a higher TEX. A ring spun yarn of about 20 TEX, for example, would be considered to have insufficient strength to enable a fabric of acceptable robustness to be woven from the yarn, and/or the yarn itself may have insufficient tensile strength to enable it to be machine knitted or woven without breaking. Increasing the twist per unit length in the yarn would increase the strength of the yarn, but this would also decrease the feel or handle of the resulting fabric so that it would be unsuitable, or much less suitable, for such next-to-skin applications, for example. Low TEX yarns also conventionally comprise a single twisted strand to increase their strength.

One form of yarn produced according to an apparatus and/or method of the invention is typically a wool yarn, or predominantly wool yarn, composed of typically two, but possibly more, very low TEX strands, of typically 15 TEX or less. Each strand comprises a very lightweight core filament. The total yarn has a TEX of about 30 or less. The yarn also has a lower level of twist, relative to a low TEX single strand ring spun yarn.

Fabric of wool, or predominantly of wool, can be woven or knitted from the yarn, to be lighter than before, but the fabric will still have similar bulk and good handle or feel. Fabrics knitted or woven from the yarn are suitable for next-to-skin applications because the yarn has low twist and thus softer handle and acceptable "feel" to the wearer. Thus, a yarn of similar properties may be produced with a lower TEX (using less of the wool or other staple fibres) without loss of bulk and with acceptable handle or feel, or alternatively, a lighter weight fabric may be produced having similar bulk and handle or feel to an otherwise equivalent fabric woven or knitted from ring spun yarn (formed with yarn of higher TEX).

The yarn also has relatively, high exposure of the fibre surface, which is advantageous for wicking away moisture from the skin in next-to-skin applications.

Fabrics produced can be visually enhanced and the increased strength is significant for new applications of warp knitting and shaped underwear.

Abrasion resistance in lightweight fabric is substantially increased when the yarn is used in the weft only.

The foregoing describes the invention including preferred forms thereof. Alterations and modifications as will be obvious to those skilled in the art are intended to be incorporated within the scope of the claims.

INDUSTRIAL APPLICABILITY

The apparatus and method of the invention enable the production of yarns having consistent yarn structures/twist profiles so that the yarns, and the fabrics and other products made from such yarns, are of a substantially consistent quality. The apparatus and method of the invention also enable the production of a wide range of yarns having different yarn structures/twist profiles that can be specifically engineered/designed to fulfil the particular purpose for which the yarn will be used. For example, soft yarns of a very low TEX, but sufficient strength, can be engineered and produced for use in next-to-skin fabrics, such as fabrics used in vests.

The invention claimed is:

1. An apparatus for producing a yarn, the apparatus comprising:

a reciprocating twisting stage adapted for simultaneously twisting one or more slivers to produce one or more twisted strands, the reciprocating twisting stage comprising one or more twist rollers adapted to rotate along an axis of rotation and to move reciprocally along the axis of rotation of the one or more twist rollers;

one or more take up holders onto which the yarn can be wound; and a control system for controlling the rotational speed of the one or more take up holders, the control system being arranged to control the one or more take up holders such that the linear speed at which yarn is wound onto the one or more take up holders is lower than the linear speed at which the one or more strands exit the one or more twist rollers, such that the yarn is subject to low tension after exiting the reciprocating twisting stage in order to control the yarn structure.

2. The apparatus of claim 1, wherein the control system is arranged to control the one or more take up holders such that the linear speed of take up of the yarn onto the one or more take up holders is between about 0.1 and 5% lower than the linear speed at which the one or more strands exit the one or more twist rollers.

3. The apparatus of claim 1, wherein the control system is arranged to control the one or more take up holders such that the linear speed of take up of the yarn onto the one or more take up holders is between about 0.25 and 3% lower than the linear speed at which the one or more strands exit the one or more twist rollers.

4. The apparatus of claim 1, wherein the control system is arranged to control the one or more take up holders such that the linear speed of take up of the yarn onto the one or more take up holders is between about 0.5 and 2% lower than the linear speed at which the one or more strands exit the one or more twist rollers.

5. The apparatus of claim 1, wherein the control system is arranged to control the rotational speeds of the one or more take up holders and one or more twist rollers relative to one another during operation of the apparatus.

6. The apparatus of claim 1, wherein the control system also enables controlled variation of the rotational speed of the one or more take up holders and the one or more twist rollers relative to one another during operation of the apparatus.

7. The apparatus of claim 1, wherein the control system also facilitates control, and variation of one or more of the transverse speed, the extent of the transverse reciprocal movement, and the rotational speed of the one or more twist rollers.

8. A method for producing a yarn, the method comprising: passing two or more slivers through a reciprocating twisting stage to produce two or more twisted strands, each strand comprising areas of twist separated by areas of non-twist; bringing the strands together to form the yarn by self-twisting with each other; and taking up the yarn onto a take up holder at a linear take up speed that is lower than the linear speed at which the strands exit the twisting stage.

9. The method of claim 8, wherein the two or more slivers are passed through the reciprocating twisting stage together with two or more core filaments, the slivers and core filaments together being of about or less than about 30 TEX, to produce two or more twisted strands, each strand comprising areas of twist separated by areas of non-twist and a core filament.

10. The method of claim 9, wherein the yarn is of between about 10 and 30 TEX.

11. The method of claim 9, wherein the yarn is between about 15 and 30 TEX.

12. The method of claim 9, wherein the yarn is between about 10 or 15 TEX and 20 or 25 TEX.

13. The method of claim 8, wherein the slivers or strands are twisted with a twist of less than 600 turns per meter.

14. The method of claim 9, wherein the slivers or strands are twisted with a twist of between about 250-300 and 400-500 turns per meter.

15. An apparatus for producing a yarn, the apparatus comprising:

a reciprocating twisting stage for simultaneously twisting one or more slivers to produce one or more twisted strands, the reciprocating twisting stage, comprising one or more twist rollers adapted to rotate along an axis of rotation and to move reciprocally along the axis of rotation of the one or more twist rollers;

one or more take uP holders onto which the yarn can be wound; and a drive system for controlling the rotational speed of one or more take up holders onto which yarn can be wound, the drive system being arranged to drive the one or more take up holders such that the linear speed at which yarn is wound onto the one or more take up holders is higher than the linear speed at which the strands exit the one or more twist rollers, such that the yarn is subject to high tension after exiting the reciprocating twisting stage in order to control the yarn structure.

16. The apparatus of claim 15, further comprising one or more take up holders onto which yarn can be wound.

17. The apparatus of claim 15, wherein the drive system is arranged to drive the one or more take up holders such that the linear speed of take up of the yarn onto the one or more take up holders is between about 0.25 and 3% higher than the linear speed at which the strands exit the one or more twist rollers.

18. The apparatus of claim 15, wherein the drive system is arranged to drive the one or more take up holders such that the linear speed of take up of the yarn onto the one or more take up holders is between about 0.5 and 2% higher than the linear speed at which the strands exit the one or more twist rollers.

19. The apparatus of claim 1, wherein the control system is further arranged to alternatively control the one or more take up holders such that the linear speed at which yarn is wound onto the one or more take up holders is higher than the linear speed at which the one or more strands exit the one or more twist rollers.

20. The apparatus of claim 15, wherein the drive system is arranged to drive the one or more take up holders such that the linear speed at which yarn is wound onto the one or more take up holders is at least about 0.1% higher than the linear speed at which the strands exit the one or more twist rollers.

* * * * *